US005702243A

United States Patent [19]

Gerlach

[11] Patent Number: 5,702,243

[45] Date of Patent: Dec. 30, 1997

[54] HYDRAULIC MOTOR WITH PRESSURE COMPENSATED END PLATES

[75] Inventor: C. Richard Gerlach, Pleasanton, Tex.

[73] Assignee: RHI Joint Venture, Corpus Christi, Tex.

[21] Appl. No.: 689,322

[22] Filed: Aug. 7, 1996

[51] Int. Cl.[6] ..... F03C 2/22

[52] U.S. Cl. ..... 418/132; 418/133

[58] Field of Search ..... 418/132, 133, 418/267, 268

[56] References Cited

U.S. PATENT DOCUMENTS

| | | | |
|---|---|---|---|
| 3,024,736 | 3/1962 | Erdmann | 418/133 |
| 3,792,936 | 2/1974 | Pettibone et al. | 418/133 |
| 4,008,002 | 2/1977 | Niemiec et al. | 418/132 |
| 4,505,654 | 3/1985 | Dean, Jr. et al. | 418/133 |
| 5,266,018 | 11/1993 | Niemiec | 418/133 |
| 5,470,215 | 11/1995 | Stone | 418/266 |

*Primary Examiner*—John J. Vrablik

*Attorney, Agent, or Firm*—Fulbright & Jaworski L.L.P.

[57] ABSTRACT

A hydraulic motor having hydraulic pressure compensating annuli for compensating for different hydraulic forces exerted on seal plates that seal both ends of a rotor and a stator.

7 Claims, 6 Drawing Sheets

HYDRAULIC MOTOR WITH PRESSURE COMPENSATED END PLATES

BACKGROUND OF THE INVENTION

The present invention relates to hydraulic motors.

Hydraulic motors known in the prior art typically comprise a rotor and a stator mounted within a housing. The rotor defines vane pockets which receive vanes. The vanes are typically spring loaded within the pockets.

The rotor is driven within the stator by hydraulic fluid that alternatingly pressurizes the vanes. Such alternating pressurization is commonly effected by injecting high-pressure hydraulic fluid from a first annulus into one side of the rotor and exhausting low-pressure hydraulic fluid from the opposite side of the rotor into a second annulus. The injection and exhaustion of hydraulic fluid is commonly controlled by apertured seal plates. The rotor and stator may be lubricated by one or more holes in the seal plate.

A major problem in the prior art is that the high-pressure annulus and the low-pressure annulus exert unequal, unbalanced forces on the seal plates. A seal plate that is fixed along its perimeter by, for example, clamping along its perimeter between a rotor and a stator, is subjected to torque as the clamped perimeter acts as a fulcrum and the pressure of the hydraulic fluid is exerted on the seal plate between the fulcrum and the center of the seal plate. Such seal plate torque causes unwanted contact between the plate and the rotor at specific points that, over time, causes friction, wear and galling on the rotor and the seal plate, decreasing the efficiency of the motor and ultimately causing failure. Further, such unequal and unbalanced seal plate torque is proportional to hydraulic pressure, substantially limiting the hydraulic pressure at which the motor may operate. Such unwanted seal plate torque, and the resulting friction, wear, and galling is a substantial limitation to the horsepower of existing hydraulic motors.

SUMMARY OF THE INVENTION

It is an object of the present invention to compensate the pressure exerted on seal plates of hydraulic motors to reduce friction.

It is another object of the present invention to extend the working life of hydraulic motors.

It is another object of the present invention to substantially increase the horsepower of hydraulic motors.

To achieve the foregoing objects, there is disclosed a hydraulic motor comprising a rotor having two ends; a stator having two ends; first and second seal plates having interior and exterior ends, the interior ends of the seal plates adjacent to the ends of the stator and the ends of the rotor; an intake annulus defined by an interior end of a first housing and the exterior end of the first seal plate, for injecting high pressure hydraulic fluid into a radial space defined by the rotor and the stator; an exhaust annulus defined by an interior end of a second housing and the exterior end of the second seal plate, for exhausting low pressure hydraulic fluid from the radial space defined by the rotor and the stator; and means for asymmetrically and hydraulically compensating for different hydraulic pressures exerted on the exterior of the seal plates from the intake and exhaust annuli. The foregoing hydraulic motor may further comprise a pressure compensating annulus defined by the interior end of the second housing and the exterior end of the second seal plate, the pressure compensating annulus having a radius; and means for hydraulically pressurizing the pressure compensating annulus to a pressure higher than a pressure exerted on the exterior end of the first seal plate along a radius equal to the radius of the pressure compensating annulus. The seal plates may be affixed to the stator.

Also to achieve the foregoing objects there is disclosed a hydraulic motor comprising a rotor having first and second ends and radial pockets; a stator having first and second ends; a first seal plate adjacent the first ends of the rotor and the stator, the first seal plate defining a first aperture communicating with the radial pockets of the rotor; a second seal plate adjacent the second ends of the rotor and the stator, the second seal plate defining a second aperture communicating with the radial pockets of the rotor, the second aperture being asymmetrical relative to the first aperture; and a pressure-compensating annulus defined by the second seal plate and a housing, the pressure-compensating annulus communicating with the second aperture.

The radial pockets may be vane pockets. The seal plates may be affixed to the stator.

DETAILED DESCRIPTION OF THE INVENTION AND PREFERRED EMBODIMENT

FIGS. 1–5 depict an exemplary and preferred embodiment of the claimed invention. Throughout the figures, like numbers refer to like features.

Figure 1:
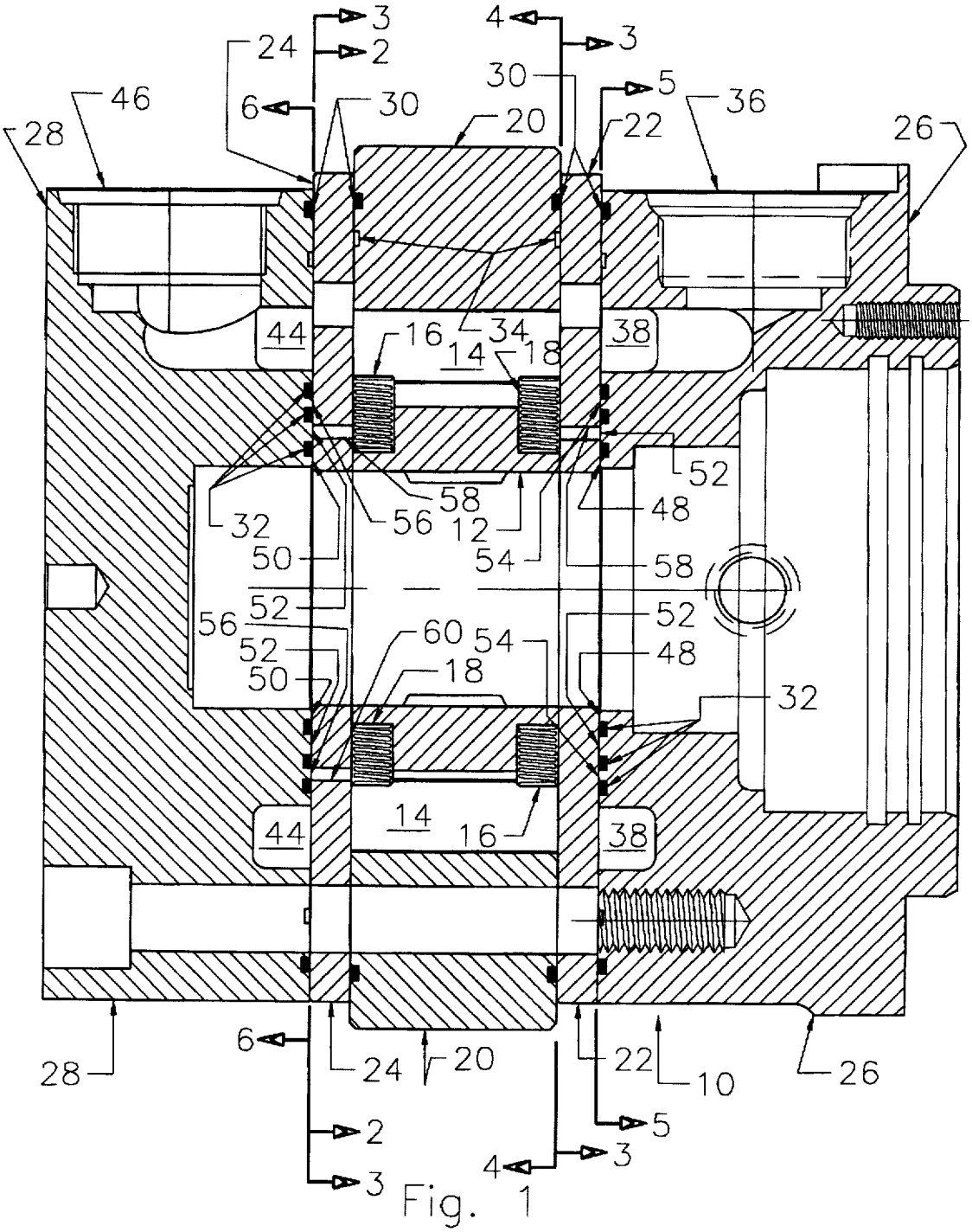
FIG. 1 depicts a cross-sectional view of a hydraulic motor in accordance with the present invention, excluding the output shaft, bearings, and shaft seal assembly.

FIG. 1 depicts a cross-sectional view of a hydraulic motor 10. The hydraulic motor 10 includes rotor 12, vanes 14, spring pockets 16, and springs 18. Rotor 12 rotates within stator 20. Seal plates 22 and 24 are adjacent to the rotor 12 and stator 20 and adjacent to housings 26 and 28, respectively.

The seal plates 22 and 24 are clamped between the stator 20 and the housings 26 and 28. O-rings 30 form seals between the stator 20, the seal plates 22 and 24, and the housings 26 and 28. Annuli 34 serve as low pressure collection chambers for hydraulic fluid that may seep between the seal plates 22 and 24, stator 20, and housings 26 and 28. Annuli 34 communicate with a hydraulic fluid case drain through means not shown. There is a clearance of about 0.001" or less between the rotor 12 and the seal plates 22 and 24 so as to permit the rotor 12 to rotate, yet minimize leakage of hydraulic fluid.

The hydraulic motor 10 is reversible. For clockwise rotation of the rotor 12, hydraulic fluid is injected into housing 26 through hydraulic fluid inlet port 36 and into high-pressure annulus 38. The hydraulic fluid flows from the high-pressure annulus 38 through intake ports 40 and auxiliary ports 40' in seal plate 22. Hydraulic fluid is exhausted from the rotor 12 and stator 20 through exhaust ports 42 and auxiliary ports 42', low-pressure annulus 44, and hydraulic fluid outlet port 46. For counter clock-wise rotation of the rotor 12, the foregoing hydraulic fluid path is reversed. When the hydraulic fluid path is reversed, the relative hydraulic fluid pressures are reversed such that, for example, annulus 44 becomes a low-pressure annulus, and annulus 36 becomes a high-pressure annulus. For purposes of clarity, the operation of the motor 10 depicted in the figures will be described in terms of clock-wise rotation of the rotor 12.

Housings 26 and 28 include pedestals 48 and 50, respectively. There is a gap of about 0.0010"–0.0025" between the pedestals 48 and 50, and the seal plates 22 and 24, respectively. 0-rings 32, seal plates 22 and 24, and housings 26 and 28 define fluid pressurized annuli 52, which annuli are equally pressurized and are features of the prior art. 0-rings 32, seal plates 22 and 24, and housings 26 and 28 also define low-pressure compensating annulus 54, and high-pressure compensating annulus 56, respectively. The annuli 52, 54, and 56 are fed hydraulic fluid from the vane pockets through "F" holes 58 and "J" holes 60 in seal plates 22 and 24. With counterclock-wise rotation of the rotor 12, the pressures of annuli 54 and 56 are reversed.

Figure 2:
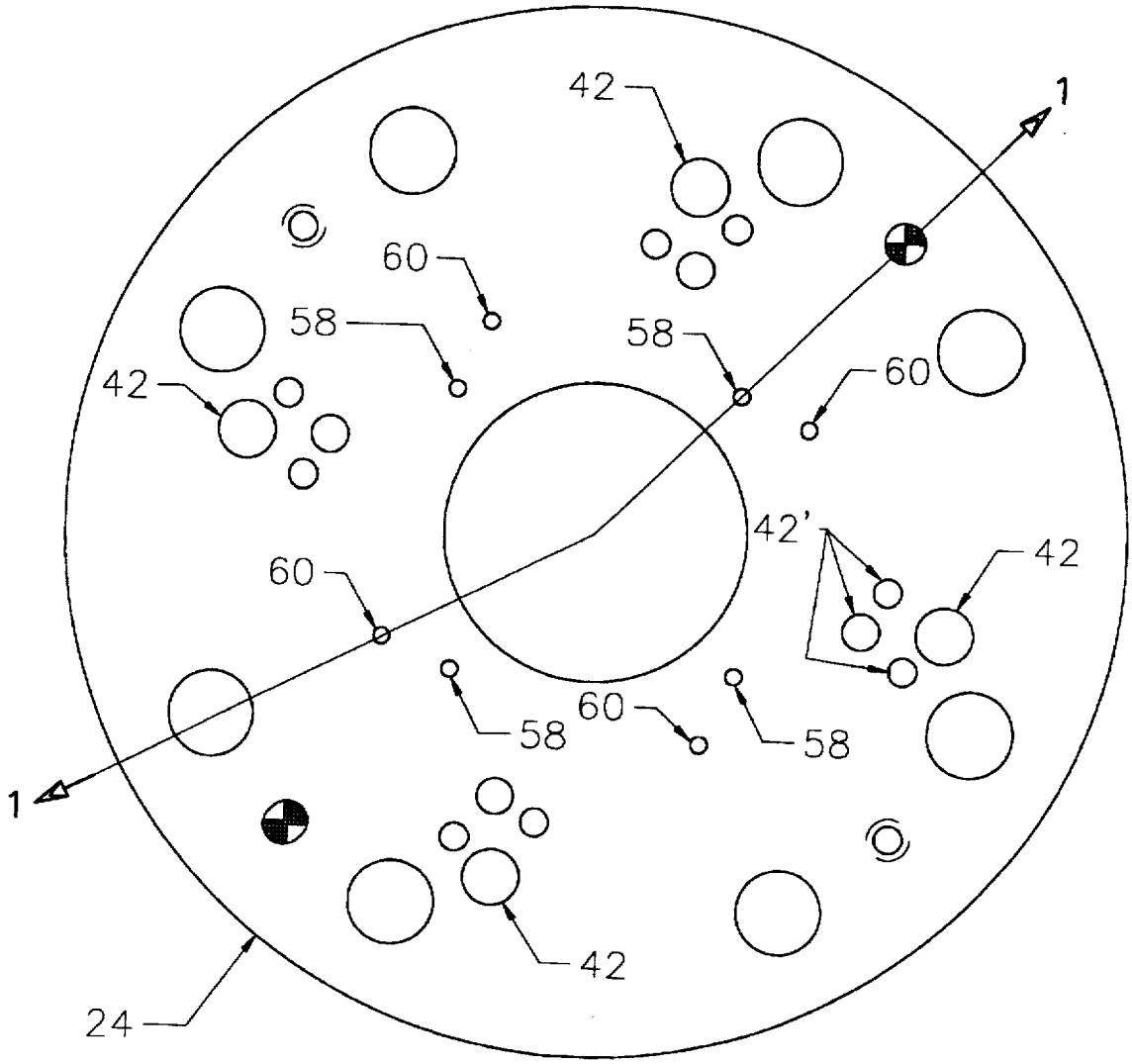
FIG. 2 depicts a side view of a seal plate of the hydraulic motor depicted in FIG. 1.

FIG. 2 depicts a side view of the seal plate 24, which is depicted in FIG. 1 along lines 1—1. FIG. 2 depicts the side of seal plate 24 adjacent housing 28. In the preferred and depicted embodiment, seal plate 24 is identical in structure to seal plate 22, except that seal plate 22 is reoriented to its side opposite that depicted in FIG. 2, such that exhaust ports 42 and auxiliary ports 42' become properly oriented to serve as intake ports 40 and auxiliary ports 40' of seal plate 22. The "F" holes 58, features of the prior art, remain symmetrical between seal plates 22 and 24 as they are oriented as depicted in FIG. 1. However, the "J" holes 60 of seal plate 22 become asymmetrical relative to each other as seal plates 22 and 24 are depicted in FIG. 1.

Figure 3:
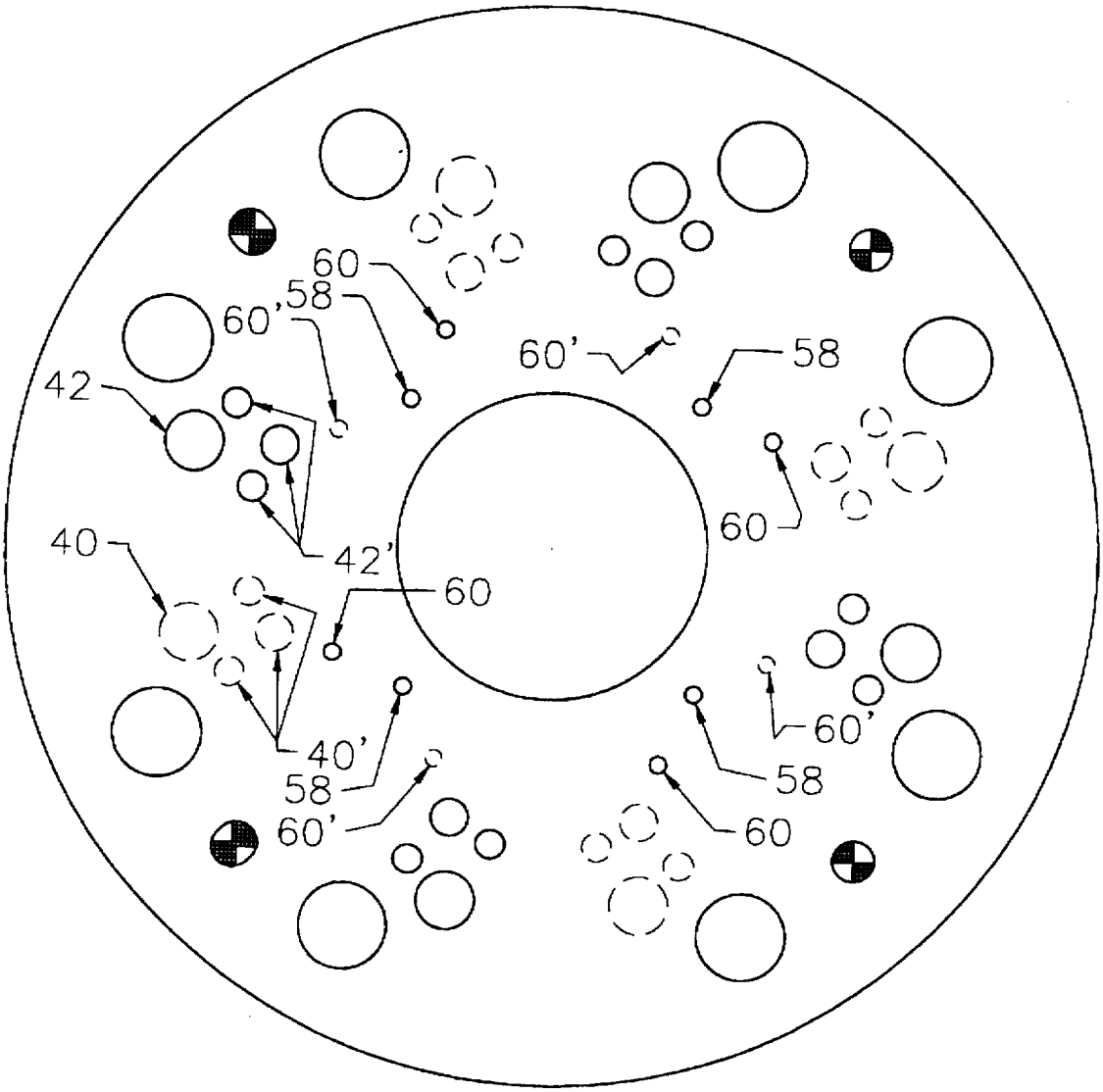
FIG. 3 depicts a side view of both seal plates of the hydraulic motor depicted in FIG. 1.

FIG. 3 depicts a side view of seal plates 22 and 24, with seal plate 24 in front of seal plate 22 as they are oriented in FIG. 1. The apertures seal plates 22 and 24 are symmetrical, except that exhaust ports 42 and auxiliary ports 42' of seal plate 24 are asymmetrical relative to the intake ports 40 and auxiliary ports 40' of seal plate 22. FIG. 3 also depicts the asymmetry of the "J" holes 60. The "J" holes of seal plate 22 are labeled 60' in FIG. 3.

Figure 4:
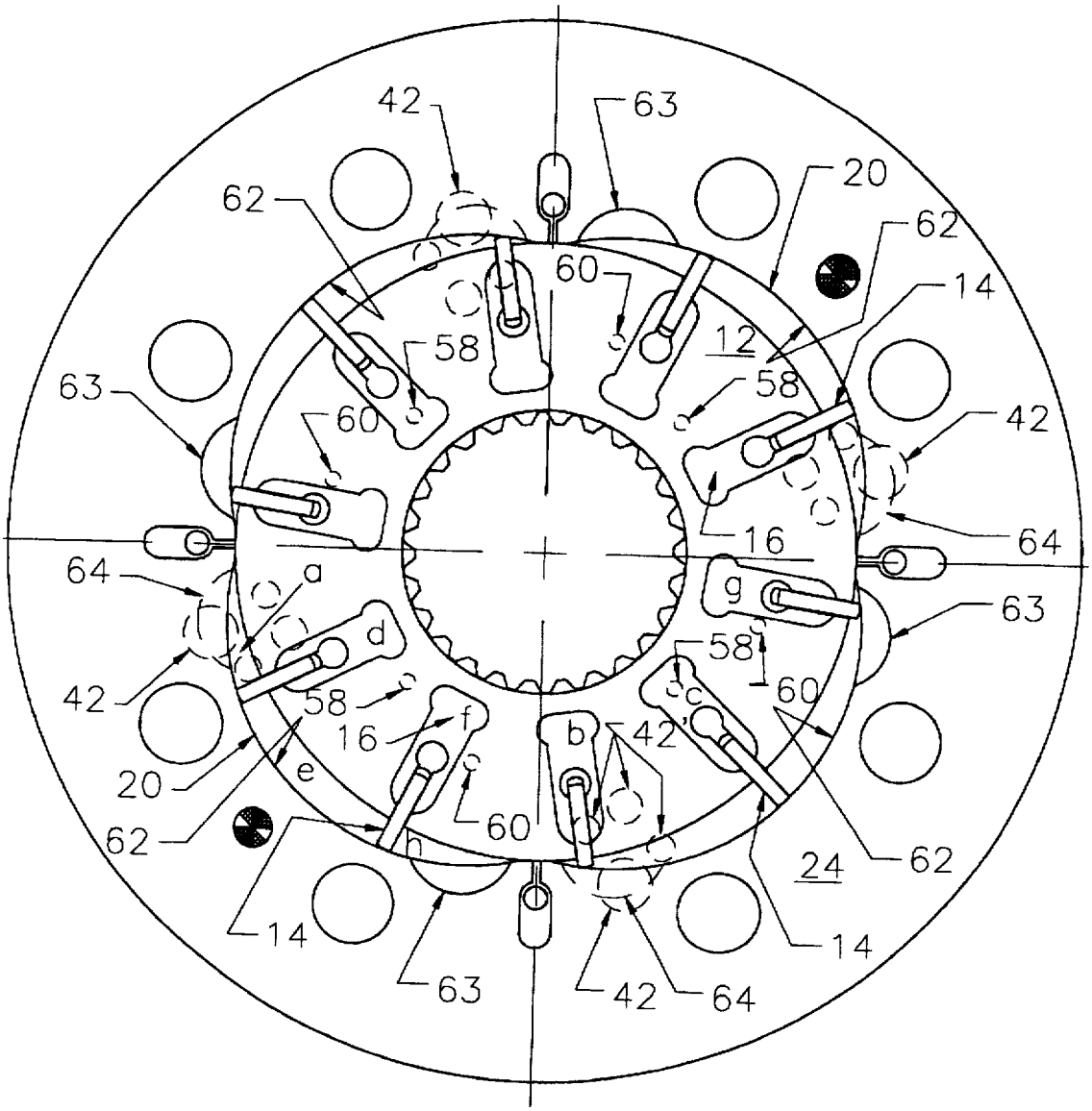
FIG. 4 depicts a partial side view of the hydraulic motor depicted in FIG. 1.

FIG. 4 depicts a side view of rotor 12 in front of seal plate 24 and a ghost portion of stater 20. Exhaust ports 42, auxiliary ports 42', "F" holes 58, and "J" holes 60 of plate 24 are dashed for view. Rotor 12 and stater 20 define radial spaces 62. Stator 20 has fluid feed cut-outs 63 and 64, adjacent intake ports 40 and 42 in seal plates 22 and 24, respectively, to reduce the restriction of fluid flow into and out of the radial spaces 62. The asymmetry of the exhaust ports relative to the intake ports regulates the flow of hydraulic fluid into and out of the radial spaces 62, such that vanes 14 are forced to rotate the rotor 12.

As rotor 12 rotates, a variety of hydraulic fluid pressures occur within the vane pockets 16 and isolated portions of the radial spaces 62. As the rotor is oriented in FIG. 4, those pressures, in decreasing order of magnitude, are reflected at points a–h.

Because the hydraulic fluid pressure oscillatingly varies in the vane pockets 16 as the rotor 12 turns, the constant hydraulic fluid pressure in the annuli 52, 54, and 56 can be controlled by positioning the "F" holes 58 and the "J" holes 60 to communicate with the rotating vane pockets 16 only when the vane pockets 16 contain the desired pressure of hydraulic fluid. Because the "F" holes 58 are symmetrical, the annuli 52 have equal pressures. Because the "J" holes 60 are asymmetrical, the annuli 54 and 56 have different pressures.

Figure 5:
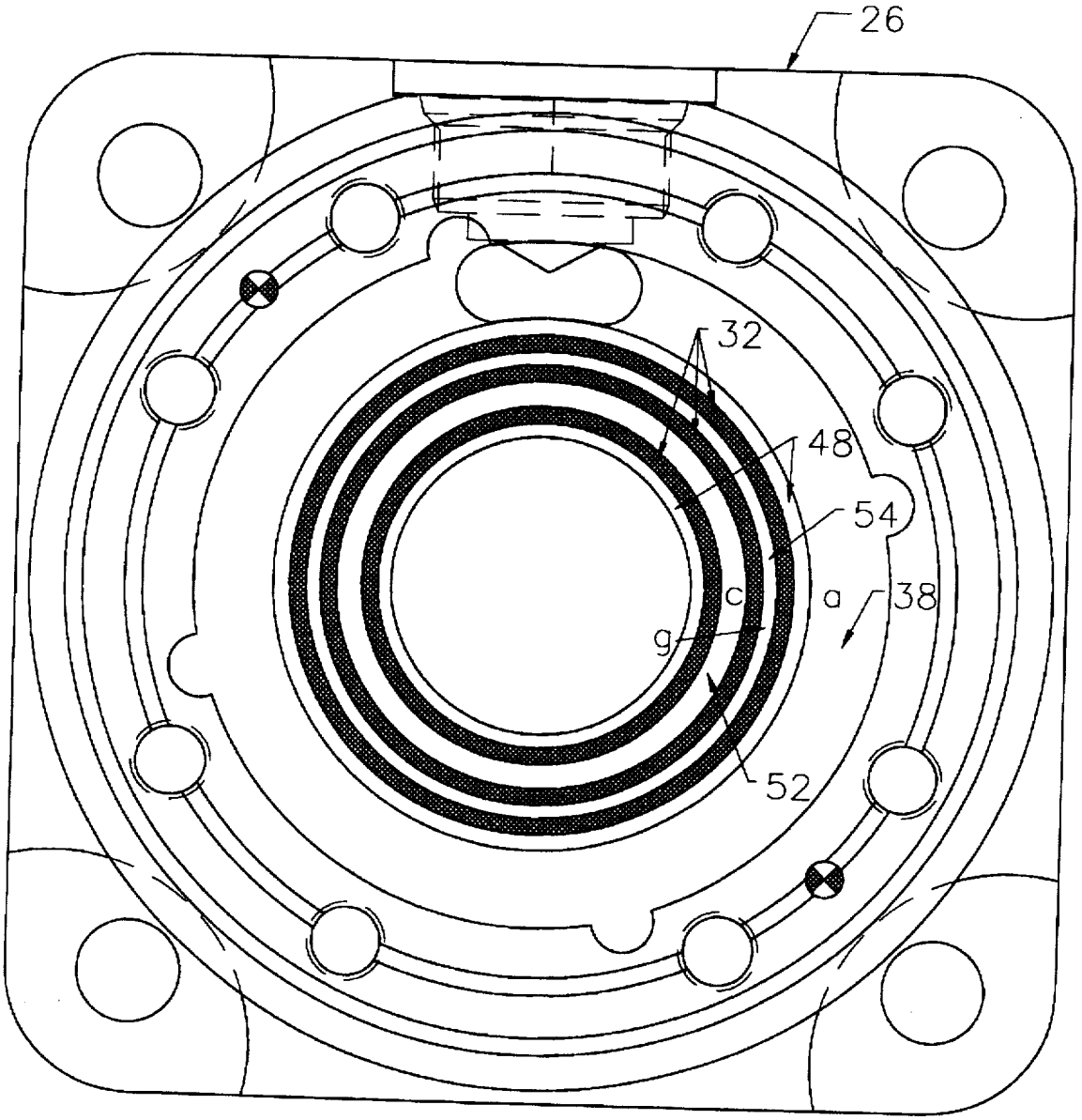
FIG. 5 depicts a partial side view of the hydraulic motor depicted in FIG. 1.
Figure 6:
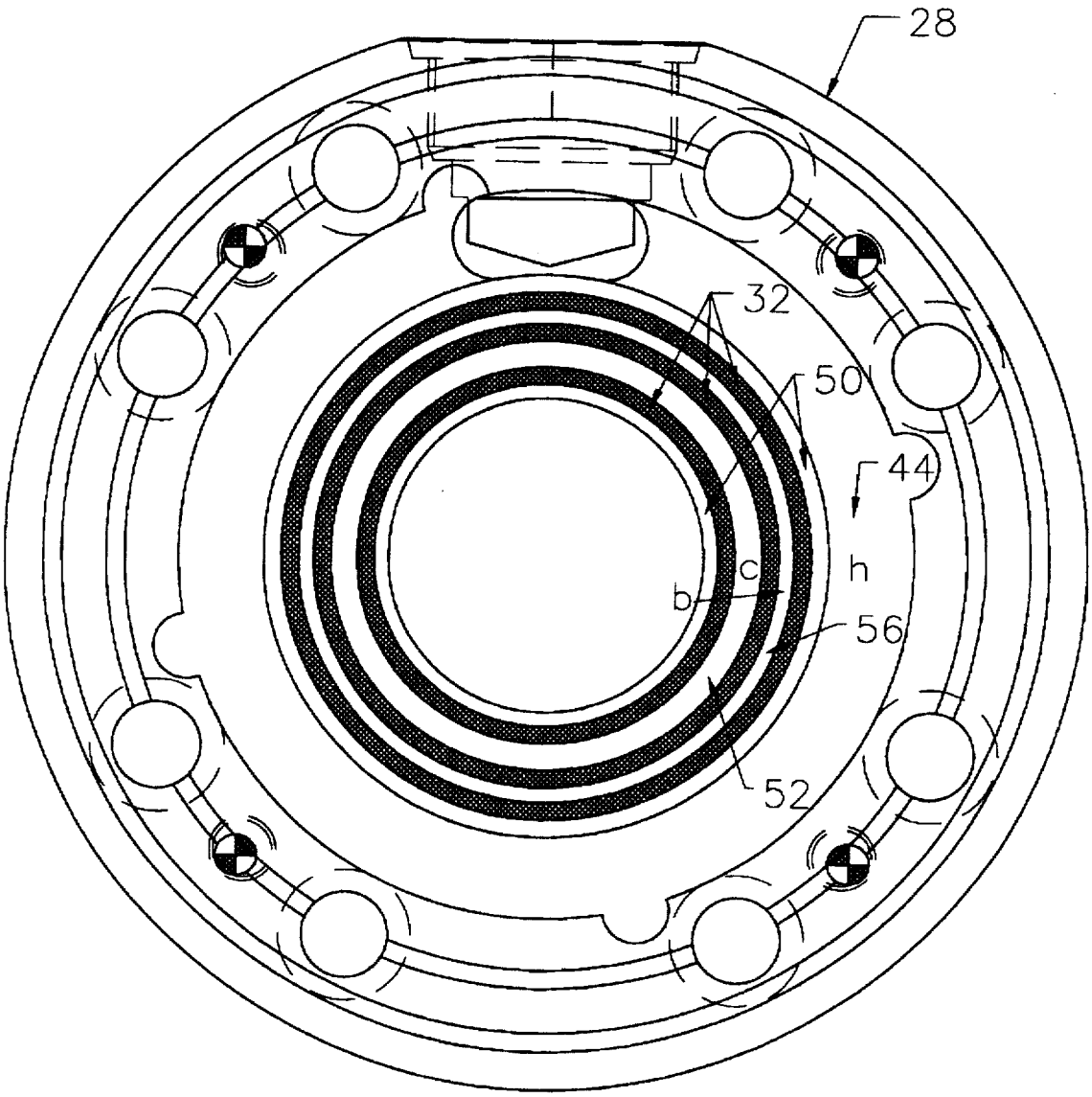
FIG. 6 depicts a partial side view of the hydraulic motor depicted in FIG. 1.

FIG. 5 depicts a side view of the housing 26 and annuli 38, 52, and 54. FIG. 6 depicts a side view of the housing 28 and annuli 44, 52, and 56. Because of the asymmetrical placement of the "J" holes 60 in the plates 22 and 24, a low hydraulic pressure can be maintained in low-pressure compensating annulus 54, while a relatively high hydraulic pressure can be maintained in high-pressure compensating annulus 56. The asymmetry in pressure between annuli 54 and 56 has the effect of minimizing seal plate torque and, in particular, the difference in seal plate torque, between seal plates 22 and 24 caused by significant asymmetry in torque exerted on those plates by high-pressure annulus 38 and low-pressure annulus 44, respectively. Correspondingly, for counterclock-wise rotation, a relatively high hydraulic fluid pressure can be maintained in compensating annulus 54, while a relatively low hydraulic fluid pressure can be maintained in compensating annulus 56.

Those skilled in the relevant art will recognize from the foregoing disclosure that many configurations of the foregoing invention may be constructed without departing from the scope of the claims. In any hydraulic motor having seal plates subject to asymmetrical operating pressures, seal plate compensation may be achieved by creating any number of asymmetrical pressure compensating annuli. The force of compensating hydraulic fluid may be controlled by any mechanism that provides suitable asymmetrical, compensating seal plate force, such as using control valving, selectively adjusting the sizes of pressure compensating annuli, selectively sizing apertures communicating with such annuli, or selectively orienting apertures relative to a source of oscillating hydraulic pressure. As used in this disclosure, "symmetrical", in the context of apertures, refers to the extent to which facing apertures mirror each other. Otherwise, "symmetrical" refers to the extent to which forces exerted on facing objects mirror each other. "Pocket" may be any pocket in a rotor, including a vane pocket.

I claim:

1. A hydraulic motor comprising:

a rotor having two ends;

a stator having two ends;

first and second seal plates having interior and exterior ends, the interior ends of the seal plates adjacent to the ends of the stator and the ends of the rotor;

an intake annulus defined by an interior end of a first housing and the exterior end of the first seal plate, for injecting high pressure hydraulic fluid into a radial space defined by the rotor and the stator;

an exhaust annulus defined by an interior end of a second housing and the exterior end of the second seal plate, for exhausting low pressure hydraulic fluid from the radial space defined by the rotor and the stator; and means for asymmetrically and hydraulically compensating for different hydraulic pressures exerted on the exterior of the seal plates from the intake and exhaust annuli.

2. The apparatus of claim 1 further comprising:

a pressure compensating annulus defined by the interior end of the second housing and the exterior end of the second seal plate, the pressure compensating annulus having a radius; and means for hydraulically pressurizing the pressure compensating annulus to a pressure higher than a pressure exerted on the exterior end of the first seal plate along a radius equal to the radius of the pressure compensating annulus.

3. The apparatus of claim 1 in which the seal plates are affixed to the stator.

4. The apparatus of claim 2 in which the seal plates are affixed to the stator.

5. A hydraulic motor comprising:

a rotor having first and second ends and radial pockets;

a stator having first and second ends;

a first seal plate adjacent the first ends of the rotor and the stator, the first seal plate defining a first aperture communicating with the radial pockets of the rotor;

a second seal plate adjacent the second ends of the rotor and the stator, the second seal plate defining a second aperture communicating with the radial pockets of the rotor, the second aperture being asymmetrical relative to the first aperture;

and a pressure-compensating annulus defined by the second seal plate and a housing, the pressure-compensating annulus communicating with the second aperture.

6. The apparatus of claim 5 in which the radial pockets are vane pockets.

7. The apparatus of claim 6 in which the seal plates are affixed to the stator.

* * * * *

UNITED STATES PATENT AND TRADEMARK OFFICE

CERTIFICATE OF CORRECTION

PATENT NO. : 5,702,243

DATED : Dec. 30, 1997

INVENTOR(S) : C. Richard Gerlach

It is certified that error appears in the above-identified patent and that said Letters Patent is hereby corrected as shown below:

Column 3, line 41, "apertures seal plates should read -- apertures of seal plates --.

Signed and Sealed this

Twenty-first Day of April, 1998

Bruce Lehman

*Attest:*

BRUCE LEHMAN

*Attesting Officer*

*Commissioner of Patents and Trademarks*